US008079414B2

(12) United States Patent
Smaardyk et al.

(10) Patent No.: US 8,079,414 B2
(45) Date of Patent: Dec. 20, 2011

(54) ELECTROMAGNETIC FREE POINT TOOL AND METHODS OF USE

(75) Inventors: John E. Smaardyk, Kingwood, TX (US); Jose A. Garcia, Katy, TX (US)

(73) Assignee: GE Oil & Gas, Inc., Houston, TX (US)

( * ) Notice: Subject to any disclaimer, the term of this patent is extended or adjusted under 35 U.S.C. 154(b) by 264 days.

(21) Appl. No.: 12/421,241

(22) Filed: Apr. 9, 2009

(65) Prior Publication Data

US 2010/0257927 A1 Oct. 14, 2010

(51) Int. Cl.
*E21B 47/09* (2006.01)

(52) U.S. Cl. ..... 166/250.13; 73/152.56

(58) Field of Classification Search ..... 166/205.13, 166/66, 255.1, 250.13; 367/35; 73/152.56; 324/357, 221
See application file for complete search history.

(56) References Cited

U.S. PATENT DOCUMENTS

| | | | | |
|---|---|---|---|---|
| 2,698,920 | A * | 1/1955 | Gieske | 324/221 |
| 3,085,428 | A * | 4/1963 | Waddill, Jr. | 73/152.56 |
| 3,233,170 | A * | 2/1966 | Rogers | 324/226 |
| 3,277,363 | A * | 10/1966 | Schuster | 324/323 |
| 4,708,204 | A | 11/1987 | Stroud | |
| 4,710,711 | A * | 12/1987 | Walkow | 324/221 |
| 4,964,462 | A | 10/1990 | Smith | |
| 5,520,245 | A | 5/1996 | Estes | |
| 6,003,597 | A | 12/1999 | Newman | |
| 6,084,403 | A | 7/2000 | Sinclair et al. | |
| 6,581,453 | B1 | 6/2003 | Bjornstad | |
| 6,845,818 | B2 | 1/2005 | Tutuneu et al. | |
| 7,389,183 | B2 | 6/2008 | Gray | |
| 2008/0042870 | A1 | 2/2008 | Orban et al. | |

* cited by examiner

*Primary Examiner* — Kenneth L Thompson
(74) *Attorney, Agent, or Firm* — Haynes and Boone, LLP

(57) ABSTRACT

Electromagnetic free point tools are configured to determine the free point of a downhole pipe in a wellbore utilizing the amplitude or phase change in a transmitted signal for stressed and unstressed pipe. Certain examples of electromagnetic free point tools comprise a housing, one or more transmitter coils, one or more receiver coils, each coil spaced apart from one another, a power source for applying an oscillating voltage to the one or more transmitter coils which then induces a current in the receiver coil(s), and electronics for measuring the induced current in the receiver coil(s). In another embodiment, at least one of the coils is axially adjustable in position within the tool to permit the relative distance between coils to be adjusted to optimize performance of the tool in various conditions. By measuring the amplitude or phase of the induced current relative to the oscillating voltage, a log of the amplitude or phase is generated while passing the tool through a length of unstressed pipe. This process may be repeated while applying a stress to the pipe to generate a second log. By comparing the amplitude or phase of the first and second logs, the free point of the pipe may be ascertained by determining when and where the two logs diverge. This method can also be used to locate collars and measure pipe thickness.

35 Claims, 9 Drawing Sheets

ELECTROMAGNETIC FREE POINT TOOL AND METHODS OF USE

BACKGROUND

The present application relates to electromagnetic free point tools. More particularly, methods and devices are provided for determining the free point of a downhole pipe in a wellbore by magnetic permeability measurements utilizing amplitude or phase change and lock-in amplifiers.

During the course of drilling oil and gas wells, the drill pipe can become stuck for any number of reasons such as differential well bore pressure, key seating, sand bridging, well bore collapse, and swelling of the borehole to name a few. The stuck drill pipe must then be removed before the well bore can be repaired and drilling operations continue. The first step in removing the stuck pipe is to determine where in the well it is stuck so that the section of pipe above this point (the free pipe) can be removed.

There are a number of methods that have been used to determine the location of the free point of the pipe (or alternatively, the stuck point of the pipe). A low resolution method involves measuring how much the pipe twists or stretches when a particular torque or force is applied to the pipe at or near the surface. Knowing the elastic properties of the drill pipe allows one to calculate the length of pipe that is free to within several hundreds of feet. To pinpoint the free point (or stuck point) within this interval, a "free point tool" is employed. The most common type are mechanical tools, which are lowered within the pipe with temporary anchors that extend to lock both ends of the tool to the borehole. Sensors within the tool detect relative movement of the tool ends when the drill pipe is twisted or stretched. If the tool is anchored below the stuck point no differential motion is detected. Gradually, the location of the stuck point is located once the tool detects differential movement. The same procedure could also be repeated in reverse, moving the tool downwards as well.

Another common type of tool for determining differential movement is similar to the aforementioned tool except that strong springs are used to hold the tool in position.

These methods suffer from several disadvantages. First, it is rather time consuming to move the tool, set the anchors, release tension on the cable, stress the drill pipe, and measure the relative motion (if any). This time-consuming procedure must be repeated until the stuck point is located. Second, it is not always straightforward to interpret the results of a given measurement so that highly experienced personnel are often required to interpret the measurements.

Previous attempts have been made to use an electromagnetic free point tool. For example, U.S. Pat. No. 4,708,204 describes an example of such a wireline tool. Such tools basically consist of two coils separated by a fixed distance on a mandrel. An oscillating voltage would be applied to the first coil (i.e. a transmitter coil) and the induced current in a second coil (i.e. a receiver coil) would be measured relative to the applied voltage of the first coil. By making continuous measurements over an interval of interest, a log of receiver coil phase or amplitude relative to the transmitter coil phase may be generated. A second log may be generated during a second pass of the tool after the pipe has been stressed. The two logs can then be compared so as to determine the stuck point of the pipe, as the two logs will be more or less identical below the stuck point and will diverge above the stuck point.

Although such tools functioned reasonably well when used in bare drill pipe, these tools failed if the drill pipe was located inside of a second ferromagnetic casing pipe. In particular, such tools failed because the operating parameters for the tool were optimized for a single string of pipe. The additional pipes perturbed the response sufficiently that the tool response to the desired pipe parameters would be obscured.

Accordingly, there is a need for improved free point tools that address one or more disadvantages of the prior art, and specifically, a free-point tool robust enough to accurately identify the stuck point of a pipe string in both cased and uncased holes is desired.

SUMMARY

The present application relates to electromagnetic free point tools. More particularly, methods and devices are provided for determining the free point of a downhole pipe in a wellbore by magnetic permeability measurements.

In one preferred embodiment, an electromagnetic free point tool comprises an elongated, tubular housing, with one or more transmitter coils carried by the housing and one or more receiver coils carried by the housing, each coil spaced apart from one another. The tool further includes a power source for applying an oscillating voltage to the one or more transmitter coils. The oscillating voltage then induces a current in the receiver coil(s), which induced current is measured by electronics carried by the housing.

The tool makes two runs along a length of pipe under investigation. The current is plotted on a log graph for each of the runs and compared. In one run, the pipe under investigation is unstressed, while in the other run, an external force, such as an axial or torsional force, is placed on the pipe during the run. An amplitude or phase change in the measured current can represent a point of interest, such as a stuck point.

In another embodiment, at least one of the coils is axially adjustable in position within the tool to permit the relative distance between coils to be adjusted. This permits the tool to be optimized for performance under various conditions, thereby eliminating the need for multiple tools. By measuring the amplitude or phase of the induced current relative to the oscillating voltage, a log of the amplitude or phase is generated while passing the tool through a length of unstressed pipe. This process may be repeated while applying a stress to the pipe to generate a second log. By comparing the amplitude or phase of the first and second logs, the free point of the pipe may be ascertained by determining when and where the two logs diverge. This method can also be used to locate collars in a pipe string and to measure pipe thickness along a pipe string.

The features and advantages of the present invention will be apparent to those skilled in the art. While numerous changes may be made by those skilled in the art, such changes are within the spirit of the invention.

BRIEF DESCRIPTION OF THE DRAWINGS

A more complete understanding of the present disclosure and advantages thereof may be acquired by referring to the following description taken in conjunction with the accompanying figures, wherein.

Figure 1:
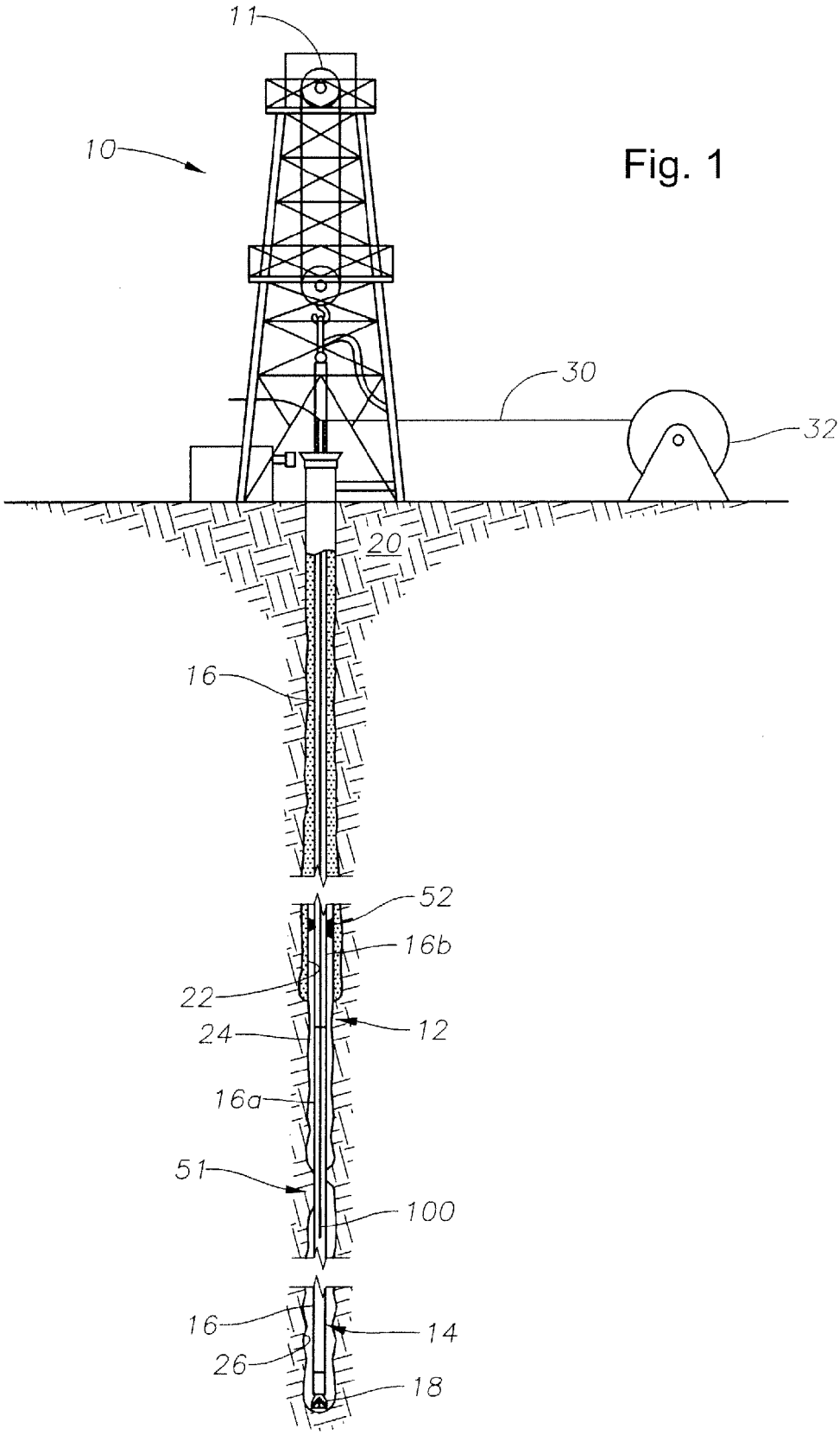
FIG. 1 illustrates a cross-section of a wellbore with the tool of the invention deployed therein.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF PREFERRED EMBODIMENTS

The present application relates to electromagnetic free point tools. More particularly, methods and devices are provided for determining the free point of a downhole pipe in a wellbore from magnetic permeability measurements.

Methods and devices of the present invention allow for determination of the free point of a pipe disposed in a wellbore via an electromagnetic free point tool. In certain embodiments, electromagnetic free point tools of the present invention comprise a housing, one or more transmitter coils disposed within the housing, one or more receiver coils disposed within the housing, each coil spaced apart from one another, a power source electrically coupled to the one or more transmitter coils for applying an oscillating voltage to the transmitter coil(s) at fixed, adjustable or multiple frequencies so as to induce one or more currents in the receiver coil(s), and electronics for measuring the induced current in each of the receiver coils.

In one embodiment of the process of the invention, by measuring the phase of the voltage created by the induced current relative to the voltage of the transmitter coil, a log of the phase can be generated by passing the electromagnetic free point tool through a length of unstressed downhole pipe. This process may be repeated after applying a stress to the pipe to generate a second log of the phase. By comparing the phase of the first log to the phase of the second log, the free point of the pipe may be ascertained by determining the point at which the two logs diverge.

In another embodiment of the process of the invention, the amplitude change of the voltage induced in the receiver coil or coils is utilized to identify a stuck point rather than the phase change, particularly in a tool to be utilized in a range of pipe diameters.

Advantages of certain embodiments include, but are not limited to, speed of execution of the method for determining the free point of a downhole pipe, ease of interpretation of the results, efficiency, accuracy, and precision of the methods herein, and the ability to determine the free point of a downhole pipe that is disposed within the confines of one or more larger diameter pipes.

In other embodiments of the invention, the tool of the invention can be utilized to measure pipe thickness or alternatively, as a collar locator.

To facilitate a better understanding of the present invention, the following examples of certain embodiments are given. In no way should the following examples be read to limit, or define, the scope of the invention.

FIG. 1 illustrates a drilling rig 10 disposed atop a borehole 12. The rig 10 includes draw works 11 which support a drill string 14. The drill string 14 consists of a plurality of series connected sections of drilling pipe 16 which are threaded end to end in a conventional fashion. A drilling bit 18 is located at the lower end of the drilling string 14. The drilling bit 18 serves to carve the borehole 12 through the earth formations 20. Metal casing 22 is shown positioned in the borehole 12 near the surface to maintain the integrity of the upper portion of the borehole 12.

An annulus 24 is formed between the drilling pipe 16 and the side walls 26 of borehole 12 and serves as a return flow path for drilling fluid pumped down drilling pipe 16. Further illustrated in FIG. 1 is a cave-in of a portion of the wall 26 of borehole 12 around the drill string 14 so that the pipe section 16*a* is stuck in the open hole as illustrated at point S1. Also illustrated at S2 is debris that has become lodged in the annulus 24 between metal casing 22 and drill string 14 so that the pipe section 16*b* is stuck in the cased hole.

The system of the invention functions to locate stuck points such as S1 and S2 along the length of the borehole 12 and drill string 14 utilizing a single free point tool sufficiently robust to identify stuck points in both cased and uncased portions of borehole 12, thereby permitting all of the free sections of drill pipe 16 above the stuck pipe joint, which is immovably jammed in the borehole 12, to be removed. Once all of the pipe above the freepoint S is removed, equipment well known in the art can be brought into the borehole 12 to free joint 15 and thereafter resume the drilling operation.

More specifically, the system of the present invention is a freepoint tool 100 which is preferably lowered into borehole 12 on a wireline 30 through the central passageway in the drill string 14. The necessary wireline vehicles 32, guide pulleys and the like are positioned over the borehole at the well head in a conventional fashion to operate the tool 100 while still controlling the weight on the bit 18 and drill string 14 by conventional means.

The wireline is conventional and consists of an armored cable with a single or multiple conducting wires which provides both a mechanical and electrical connection between the tool 100 and the wireline control and monitoring equipment at the surface. The tool 100 descends down through the central aperture in the drilling string 14 from the wellhead in order to locate the stuck point S through measurable changes in the physical characteristics of the pipe related thereto. Those skilled in the art will appreciate that wireline 30 provides power and surface communications to tool 100 in the conventional manner. In an alternative embodiment of the invention, tool 100 may be lowered on a non-conducting vehicle such as slickline, coiled tubing or other device, and in such case, tool 100 may be provided with local power, communications and local memory to store the acquired data for subsequent read-out at the surface.

It is well known that when a ferromagnetic member such as a drill pipe is stretched, compressed or torqued, the magnetic permeability of the material changes. Further, if a magnetic field is induced into the walls of drill pipe, eddy currents will be generated in the drill pipe wall. The pattern and strength of the eddy currents will be related to the permeability of the material comprising the pipe. The preferred way to measure the permeability related eddy currents in a drill pipe is by using a receiving coil to detect the electromagnetic fields produced by those eddy currents in the pipe material.

Figure 2:
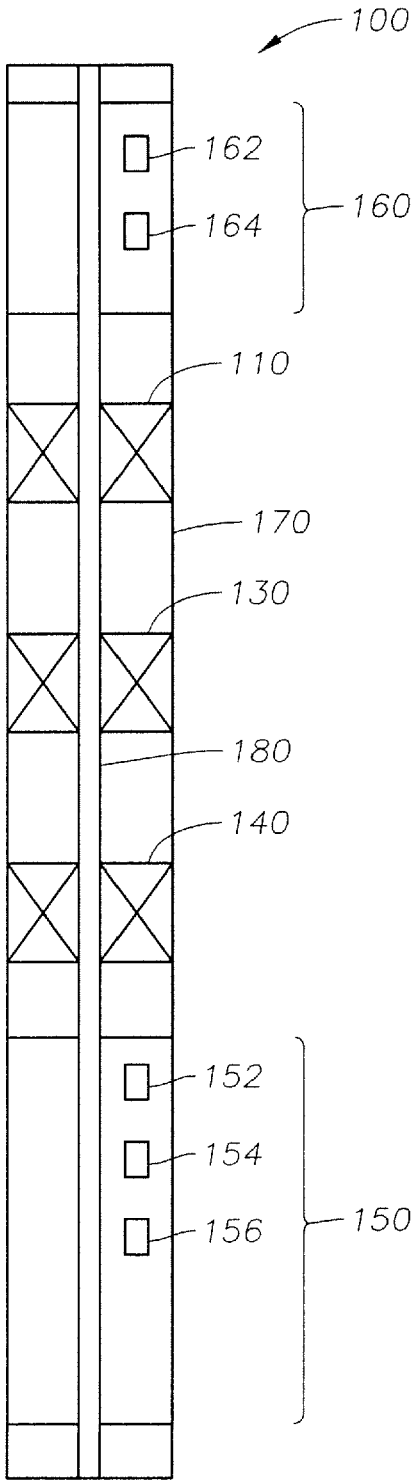
FIG. 2 illustrates a cross-section of a downhole electromagnetic free point tool in accordance with one embodiment of the present invention.

Turning now to FIG. 2, free point tool 100 comprises housing 170, mandrel 180, transmitter coil 110, first receiver coil 130, second receiver coil 140, and electronics 150 & 160.

Mandrel 180 provides a member about which other elements in housing 170 may be disposed. In certain embodiments, mandrel 180 allows elements of electromagnetic free point tool 100 to be centered or otherwise positioned at fixed points within housing 170, while in other embodiments of the invention, the position of such elements may be adjustable along the length of mandrel 180. Transmitter electronics 160 applies an oscillating voltage to transmitter coil 110. First receiver coil 130 and second receiver coil 140 are spaced apart from one another and from transmitter coil 110. The oscillating current of transmitter coil 110 induces a corresponding current in first receiver coil 130 and second receiver coil 140. Electronics 150 is communicatively coupled to first receiver coil 130 and second receiver coil 140 and measures the induced current in each receiver coil 130 and 140.

In one embodiment of the invention, tool 100 has a single receiver coil 130 and the spacing between the transmitter coil 110 and the receiver coil 130 is determined based on maximizing the observed change in the voltage amplitude in the receiver coil over as wide a range of frequencies as possible. This is determined by making measurements in stressed and unstressed pipe over the desired frequency range for each coil spacing. In addition, the measurements are repeated in different standard diameter drill pipe, such as 5" pipe or 2⅞" pipe.

In another embodiment of the invention, tool 100 has a first receiver coil 130 spaced apart a predetermined distance from transmitter coil 110 based on optimization of tool 100 for use with a 5" pipe and a second receiver coil 140 spaced apart a predetermined distance from transmitter coil 110 based on optimization of tool 100 for use with a 2⅞" pipe, it being understood from the graphs referenced in FIGS. 6, 7 and 8 that use of the tool 100 is optimized in differing diameter pipes by providing different transmitter-receiver coil spacing. By utilizing multiple coils in this manner, it is possible to take multiple measurements of various portions of the wellbore in a single run. In other words, the tool can be optimized for both single string measurements, i.e., when the pipe string under investigation is in an open hole, and multiple string measurements, i.e., when the pipe string under investigation is in a cased hole.

In this same vein, one or more coils 110, 130, 140 may be moveable along mandrel 180 so as to provide the ability to adjust the spacing between coils in order to maximize the response of tool 100 for a given set of conditions, which condition variables may include, but are not limited to, pipe diameter and operating frequency. Thus, for example, a receiver coil may be axially moved along mandrel 180 until the spacing between the receiver coil and the transmitter coil is approximately 8", thereby maximizing the amplitude change that will occur when tool is operated at 120 Hz and is disposed in a 2⅞" pipe string (See FIG. 7*b*). In another example, a transmitter coil may be axially moved along mandrel 180 until the spacing between the receiver coil and the transmitter coil is approximately 16", thereby maximizing the amplitude change that will occur when tool is operated at 90 Hz and is disposed in a 5" pipe string (See FIG. 6*b*).

In any event, electromagnetic free point tool 100 may then perform these measurements while traversing an axial length within a downhole pipe. By measuring the phase of the induced current of each receiver coil relative to the oscillating voltage applied to the transmitter coil, a log can be generated of the phase or amplitude as a function of distance traversed by electromagnetic free point tool 100.

Subsequently, the downhole pipe is stressed at or near the surface, either by applying a torsional stress, a stress in tension, or a combination thereof. While the pipe is stressed, electromagnetic free point tool 100 repeats the aforementioned measurements along at least a portion of the distance previously traversed in the downhole pipe. Because stressing a pipe will affect the magnetic permeability of the pipe, repeating the phase or amplitude measurements along the stressed length of pipe will yield a different log of phase or amplitude measurements than the previous log of measurements of the unstressed pipe. The subsequent phase or amplitude logs of the pipe below the free point (i.e. the stuck pipe) should be relatively identical, because in both instances, the pipe below the stuck point is unstressed. Notably, the foregoing system functions equally well in cases of "partial sticking" where a pipe section may be movable, but constrained in some fashion.

One of ordinary skill in the art, with the benefit of this disclosure, will appreciate that one could reverse the order of the phase/amplitude measurements above. For example, the electromagnetic free point tool 100 could generate a log of the pipe when stressed first and then, subsequently generate a log of the pipe when unstressed. Additionally, it is recognized that any number of receiver coils could be used at different fixed distances from the transmitter coil, including, but not limited to, coil spacings from about 5 inches to about 24 inches, and in certain embodiments from about 6 inches to about 16 inches. Alternatively, as stated above, one or more of the coils may be adapted to automatically displace axially within housing 170 so as to measure phase shifts or amplitude changes at different spacings between coils.

Receiver electronics 150 comprises memory 152, CPU 154, and power source 156. CPU 154 receives and processes measurement data, which may then be stored in local memory 152 or communicated to the surface via the logging cable 30. Power source 152 provides power to electromagnetic free point tool 100, including supplying power to generate the oscillating voltage applied to transmitter coil 110.

Transmitter electronics 160 comprises a signal generator 164 for generating an an oscillating current in transmitter coil 110. In certain embodiments, signal generator 164 is an oscillator.

In one preferred embodiment, a phase sensitive detector or "lock-in amplifier" may be used for increased sensitivity, stability and noise immunity may also be provided. As illustrated in FIGS. 5, 6 and 7, the phase shift or amplitude change that is likely to occur about a free point is comparatively small. Thus, at times, it may be difficult to distinguish between a stuck point event, i.e., a resulting phase shift or amplitude change, and external noise from the wellbore, pipe string or other sources. The lock-in amplifier of the invention achieves this by acting as a narrow bandpass filter which removes much of the unwanted noise while allowing the desired signal which is to be measured. In operation, the frequency of the signal to be measured and hence the pass band region of the filter is set by a reference signal, namely the signal generated by the signal generator 164, which is supplied to the lock-in amplifier along with the unknown signal.

It is explicitly recognized that instead of measuring the phase, voltage amplitude in each coil may be measured and compared. Additionally, one could measure both amplitude and phase to ascertain additional detail regarding the pipe being measured.

Figure 3:
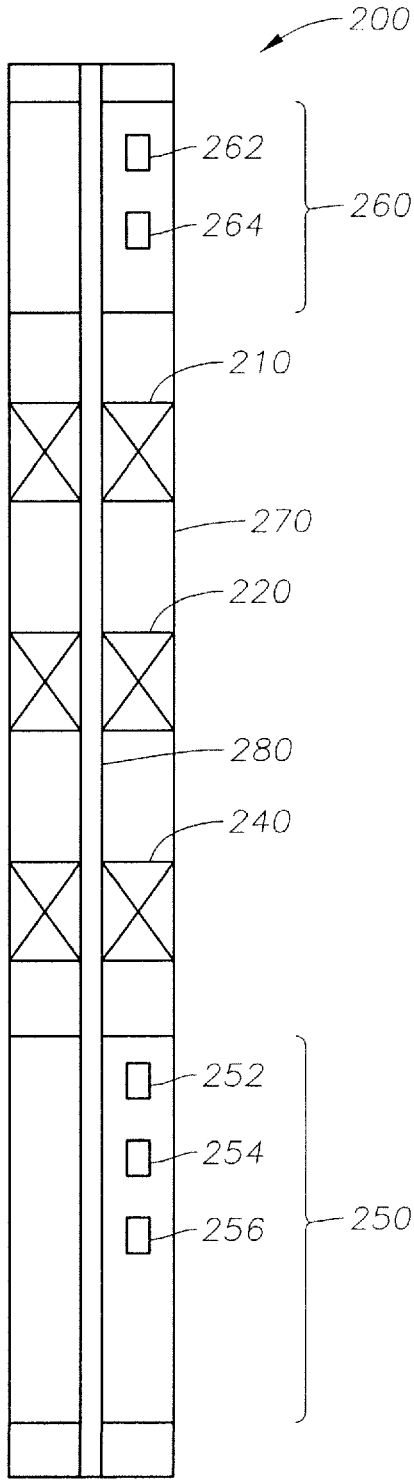
FIG. 3 illustrates a cross-section of a downhole electromagnetic free point tool in accordance with another embodiment of the present invention.

FIG. 3 illustrates a cross-section of a downhole electromagnetic free point tool in accordance with another embodiment of the present invention. The embodiment depicted in FIG. 3 is identical to FIG. 2, except that electromagnetic free point tool 200 comprises two transmitter coils instead of one transmitter coil. Here, first transmitter coil 210 and second transmitter coil induce a current in receiver coil 240. In this way, a plurality of transmitter coils may be used with one receiver coil instead of one transmitter coil being used in conjunction with a plurality of receiver coils. Additionally, it is recognized that any additional number of transmitter coils and receiver coils could be used in conjunction with electromagnetic free point tool 200.

As with tool 100, the coil spacing between the various coils of tool 200 may be fixed or adjustable to accommodate the various operating parameters of the tool. Moreover, tools 100 and 200 may be operated a multiple, simultaneous or adjustable frequencies in order to further optimize tool results over a range of operating conditions.

Figure 4:
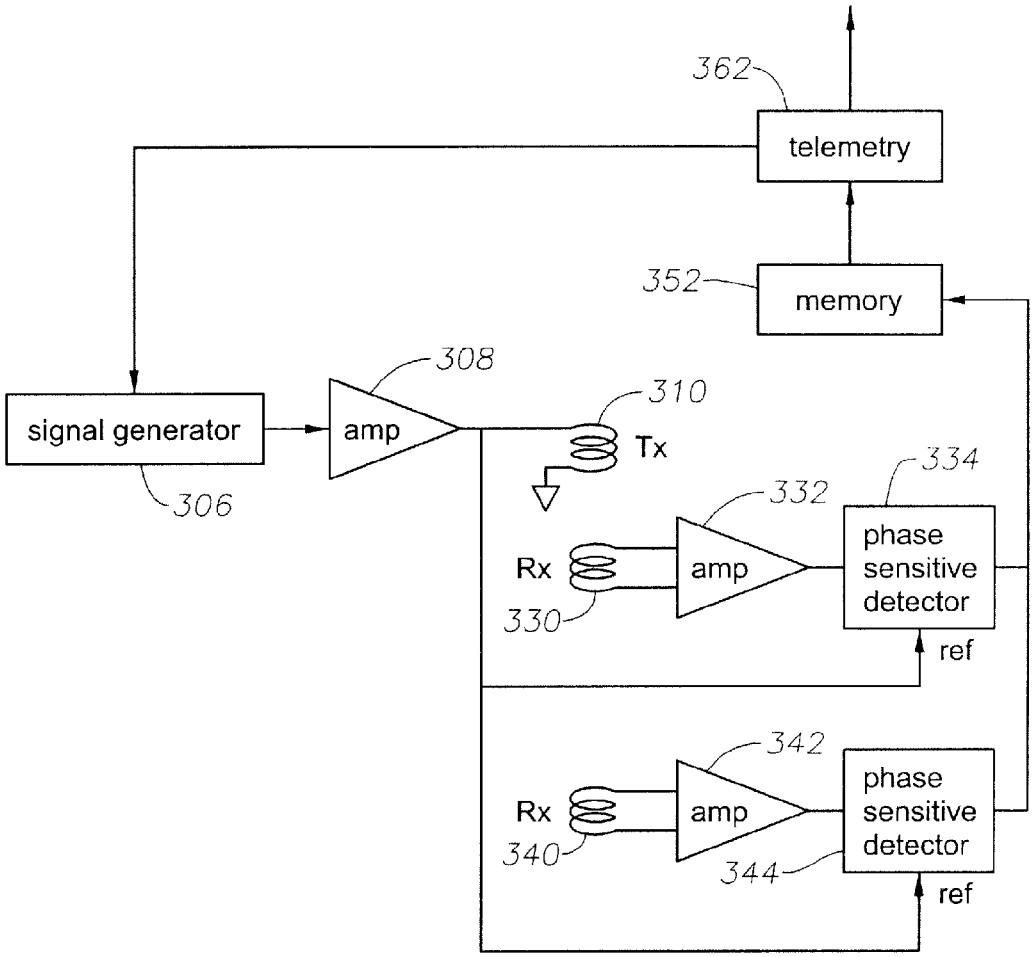
FIG. 4 illustrates an electrical schematic of a downhole electromagnetic free point tool in accordance with one embodiment of the present invention.

FIG. 4 illustrates an electrical schematic of a downhole electromagnetic free point tool in accordance with one embodiment of the present invention.

Signal generator 306 generates an oscillating voltage that is amplified by amplifier 308 and applied to transmitter coil 310 so as to propagate an electromagnetic wave towards the pipe string under investigation. Said electromagnetic wave creates eddy currents in the pipe string. The eddy currents give rise to electromagnetic fields that induce currents in both receiver coil 330 and receiver coil 340. Relevant oscillating frequencies suitable for use with certain embodiments of the present invention include, but are not limited to, about 30 to about 150 Hz. The induced currents arising from the eddy currents in the pipe are then amplified by amplifiers 332 and 342 respectively. Phase sensitive detectors 344 are provided to filter noise and determine the phase or amplitude of the induced currents in receiver coils 330 and 340 relative to the applied oscillating voltage of transmitter coil 310. To accomplish this, the original amplified signal from signal generator 306 is provided to phase sensitive detectors 334 and 344 as a reference signal. In any event, phase or amplitude data may be transmitted directly to the surface via telemetry 362 or stored locally in memory 352 and then communicated to the surface via telemetry 362 (or other methods known in the industry), where the data and measurements may be interpreted by skilled artisans to identify stuck points or other points of interest (such as collars, etc.)

As used herein, the terms, "adapted to" and "configured to" refer to mechanical or structural connections between elements to allow the elements to cooperate to provide the described effect; these terms also refer to operational capabilities of electrical elements such as analog or digital computers or application specific devices (such as an application specific integrated circuits (ASIC)) that are programmed to perform a sequel to provide an output in response to given input signals. Furthermore, it is explicitly recognized that any of the features and elements of any of the embodiments herein may be combined with and used in conjunction with any of the features and elements of any of the other embodiments disclosed herein.

To facilitate a better understanding of the present invention, various data supporting the above comments will be referenced and discussed. In no way should the following examples be read to limit, or define, the scope of the invention.

Figure 5A:
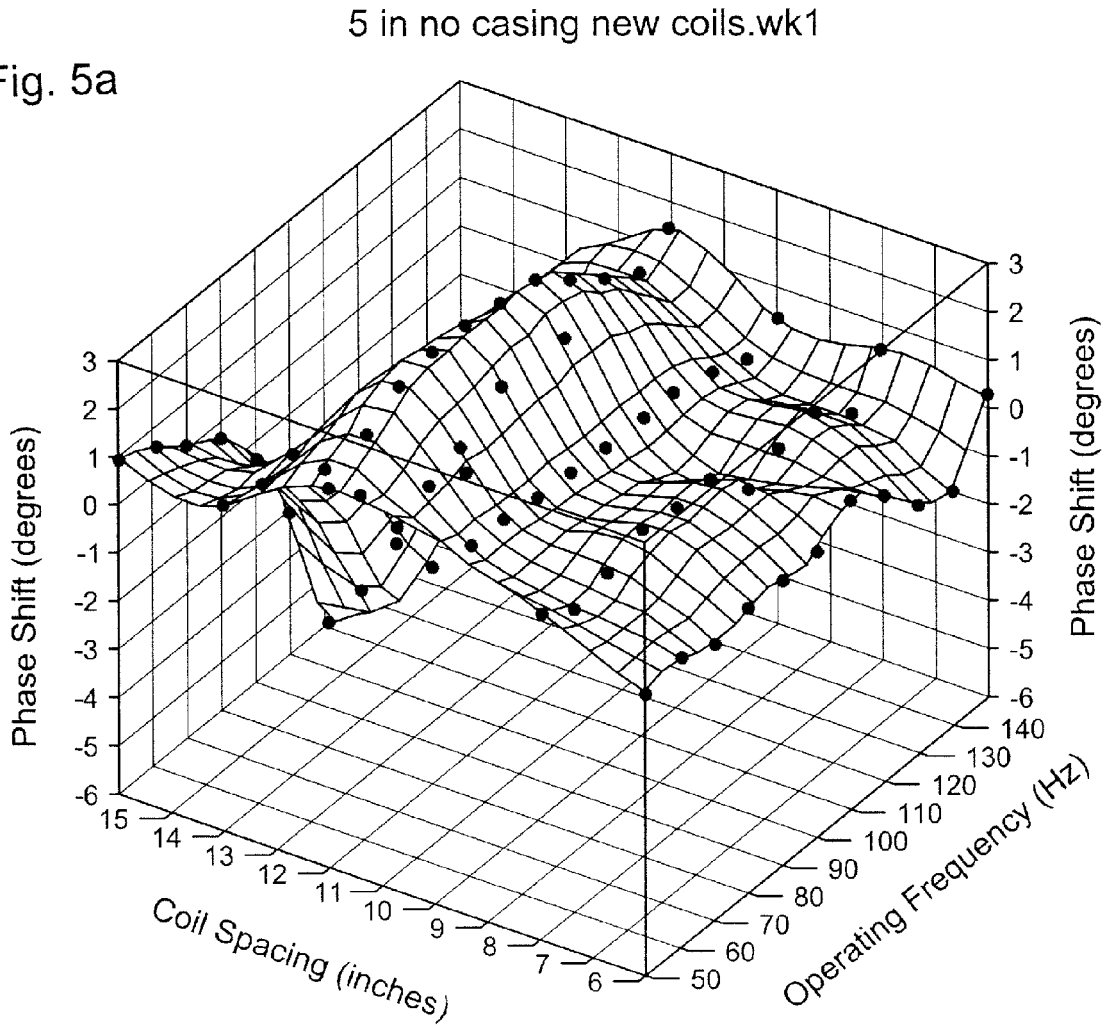
FIG. 5*a* illustrates free point tool data of electromagnetic phase shift over varied frequency and coil spacing ranges between stressed and unstressed 5" pipe.
Figure 5B:
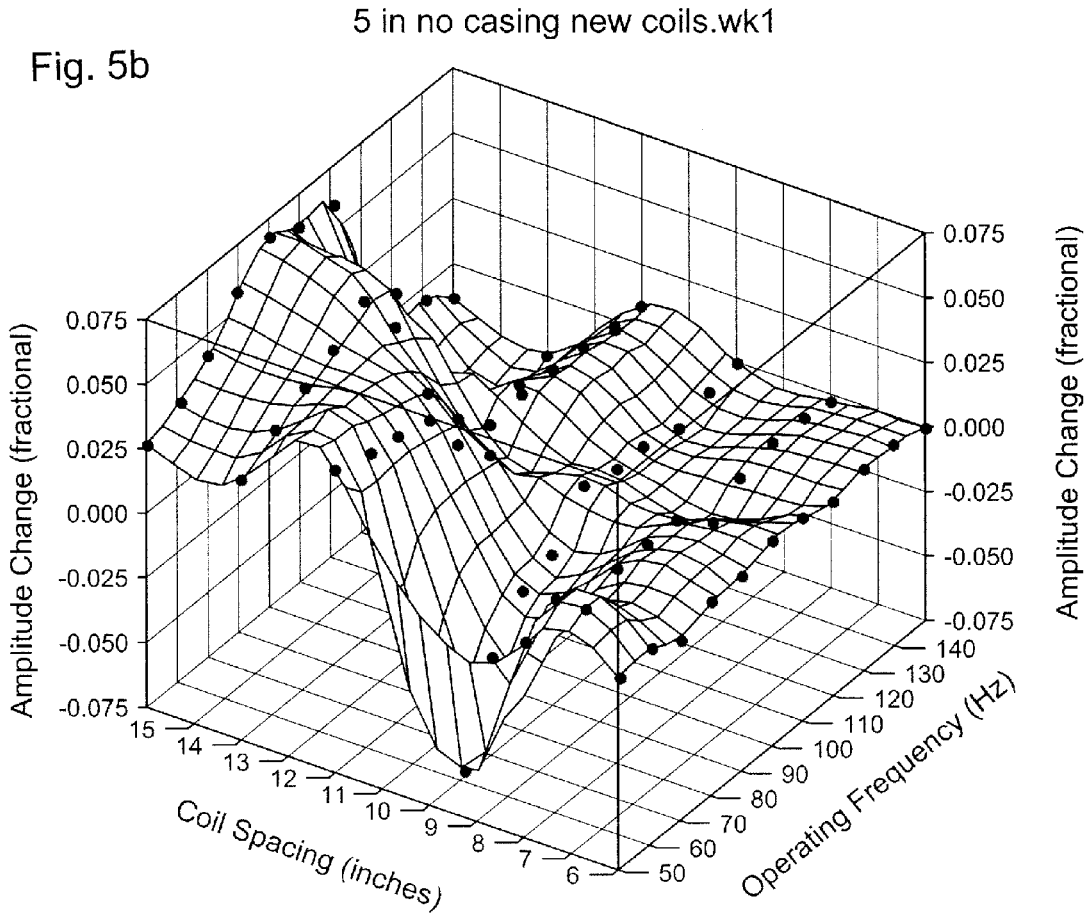
FIG. 5*b* illustrates free point tool data of electromagnetic amplitude change over varied frequency and coil spacing ranges between stressed and unstressed 5" pipe.
Figure 6A:
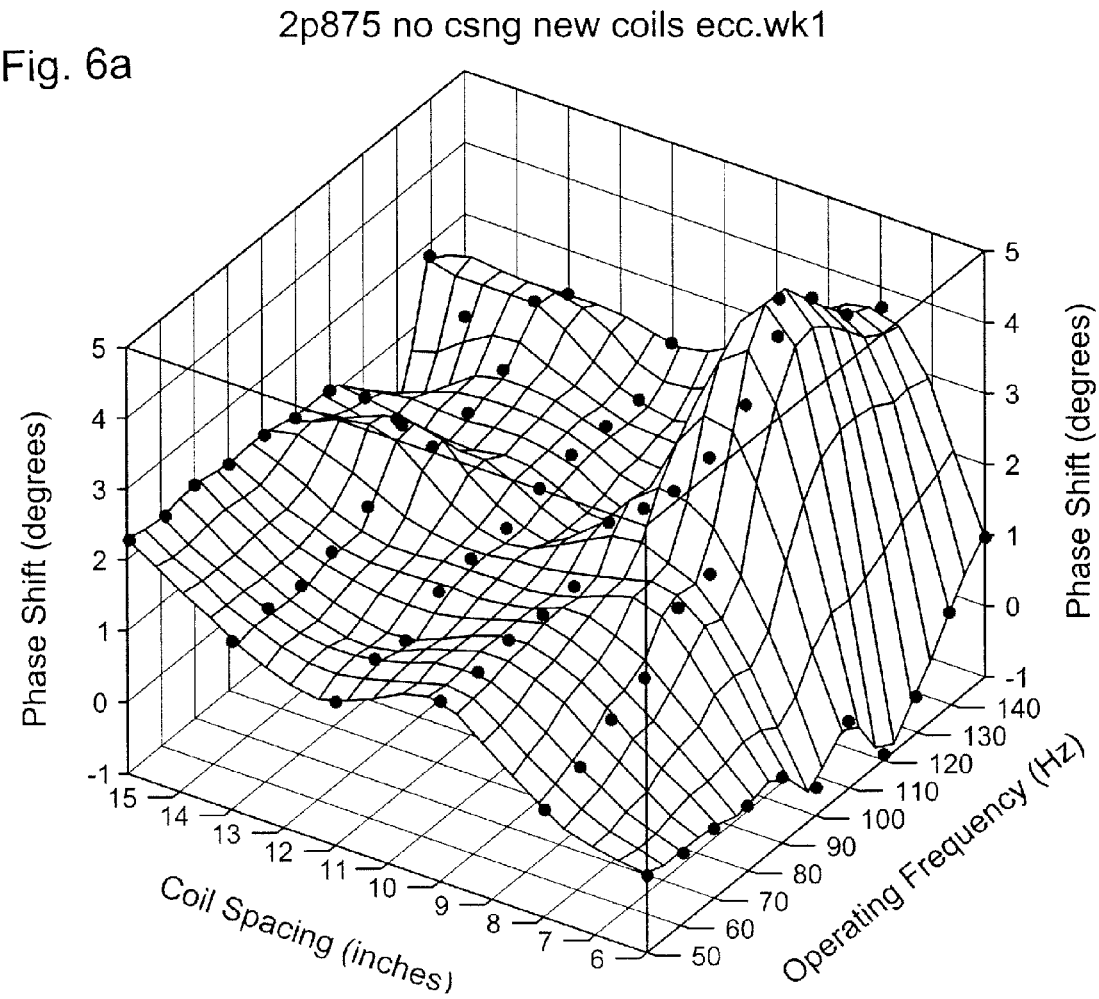
FIG. 6*a* illustrates free point tool data of electromagnetic phase shift over varied frequency and coil spacing ranges between stressed and unstressed 2⅞" pipe.
Figure 6B:
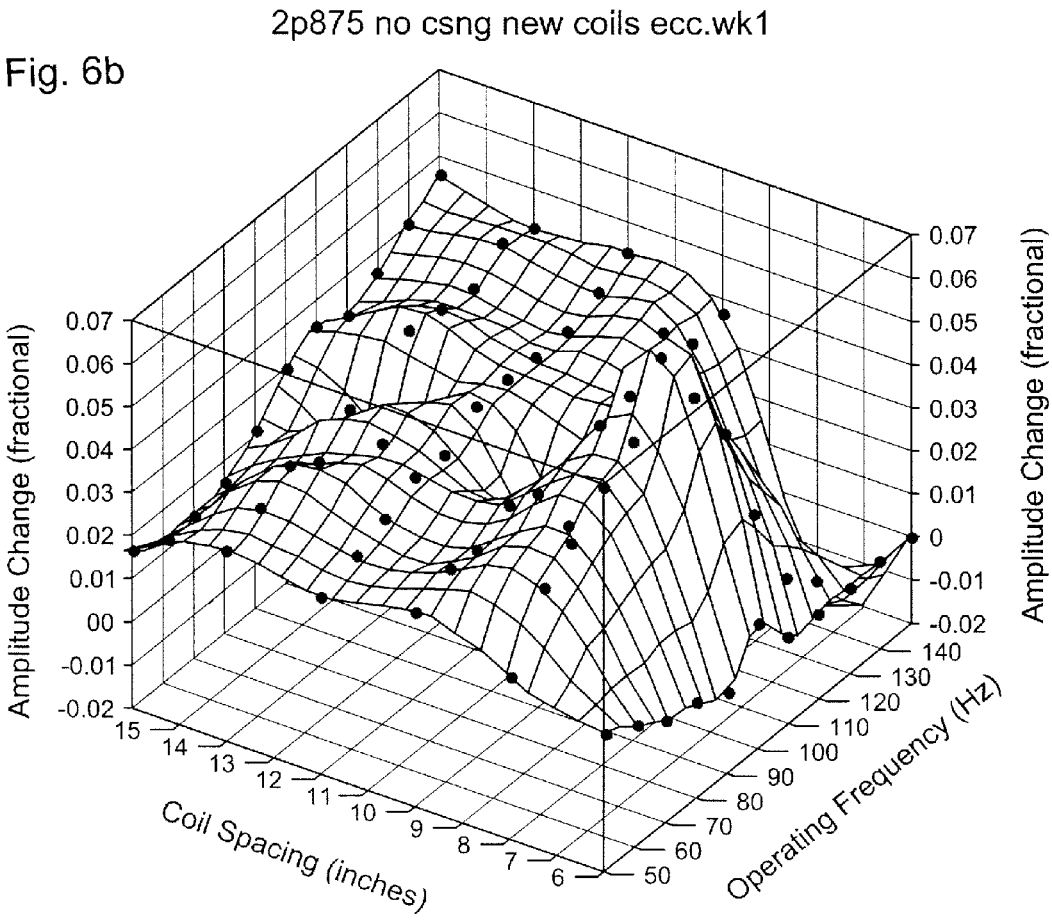
FIG. 6*b* illustrates free point tool data of electromagnetic amplitude change over varied frequency and coil spacing ranges between stressed and unstressed 2⅞" pipe.

FIGS. 5*a* and 5*b* show how variations in coil spacing and frequency affect the changes in signal phase and amplitude, respectively, observed when comparing measurements made in a 5-in pipe that is unstressed (FIG. 5*a*) with measurements made in the same pipe that is placed under stress, either torsional, longitudinal or a combination (FIG. 5*b*). FIGS. 6*a* and 6*b* are similar plots for a 2⅞-in diameter pipe. The object is to identify a subset of conditions such that, for a fixed coil spacing, the response of the tool is relatively insensitive to the operating frequency resulting in the most robust measurement possible. Thus, in FIG. 5*b*, it is seen that the amplitude change due to the applied stress is most pronounced for operating frequencies between 50 and 150 Hz when the transmitter to receiver coil spacing is 12 inches.

It can also be seen from studying the data in FIGS. 5 and 6 that coil spacings other than 12 inches can yield greater changes in phase or amplitude under particular combinations of pipe size and operating frequency. Thus it is possible to construct a tool with multiple coils at different spacings or moveable coils and operating at more than one frequency that could provide more sensitivity for each set of conditions than is possible with a single, fixed coil spacing and single, fixed operating frequency. This becomes of particular importance if the stuck pipe is surrounded by one or more additional strings of casing.

Figure 7A:
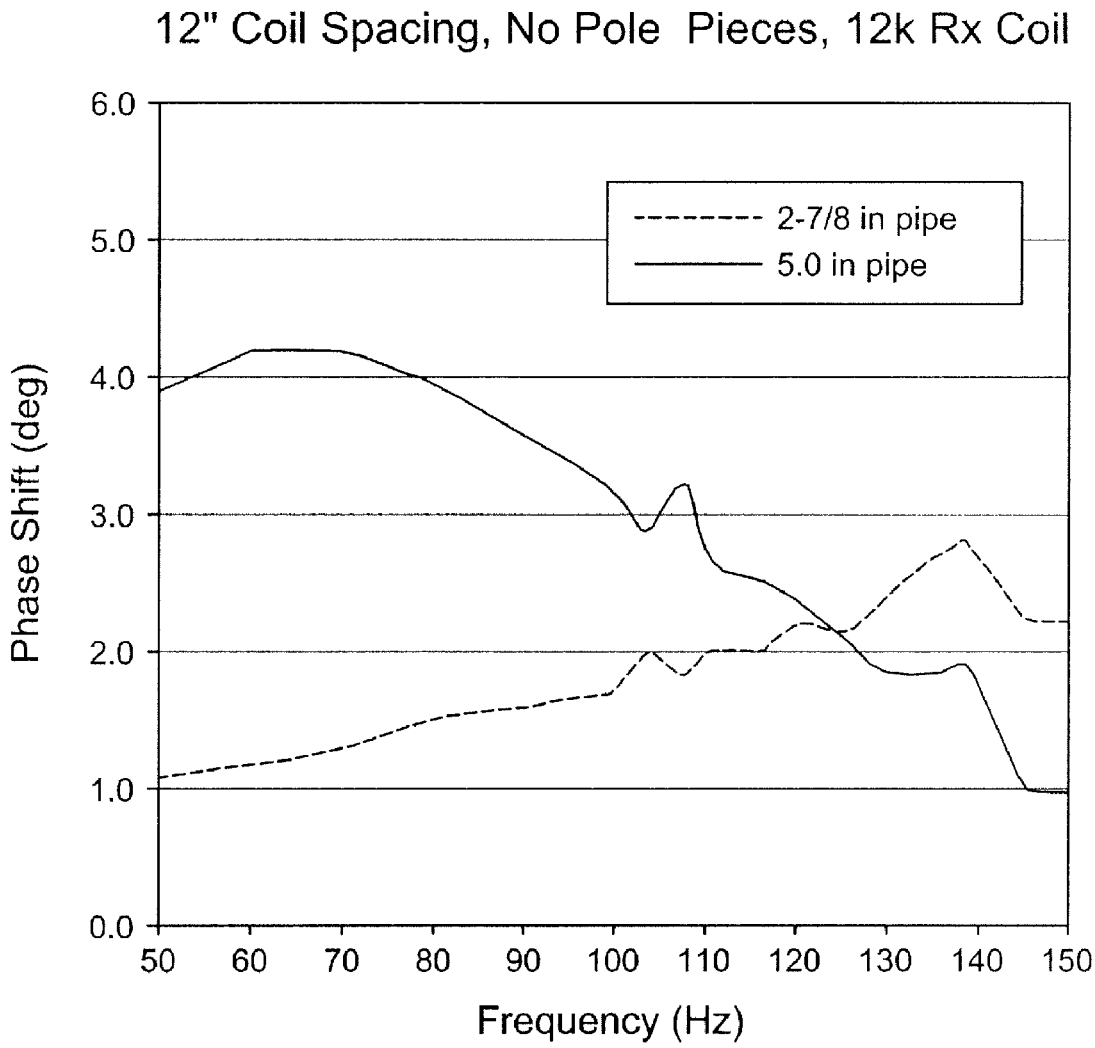
FIG. 7*a* illustrates the significant difference in phase shift that can exist over a frequency range of a free point tool disposed in a 5" pipe and a 2⅞" pipe.
Figure 7B:
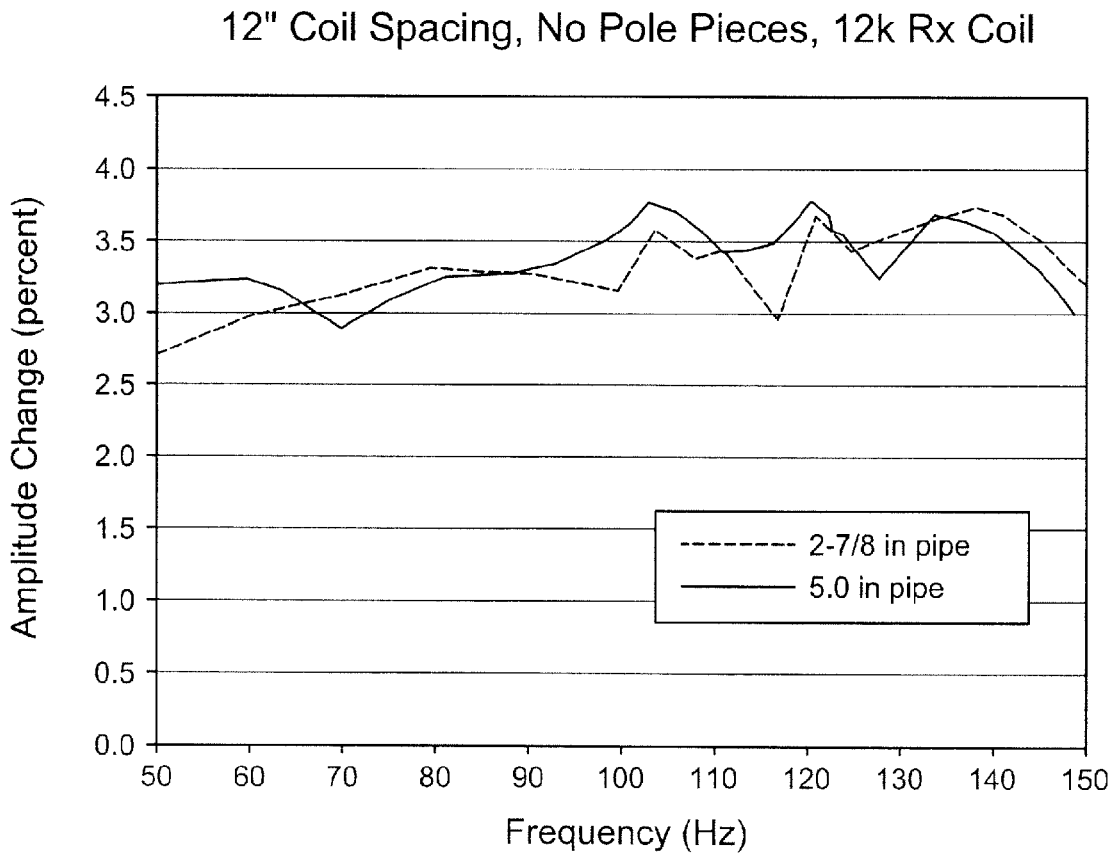
FIG. 7*b* illustrates the convergence of amplitude change that exists over a frequency range of a free point tool disposed in a 5" pipe and a 2⅞" pipe.

FIGS. 7*a* and 7*b* represent two-dimensional slices through the data plotted in FIGS. 5 and 6 and illustrate the difference between phase shift measurements and amplitude changes over a range of frequencies for a free point tool disposed in 5" pipe and 2⅞" pipe, where the coil spacing is held constant at 12". FIG. 7*a* shows the signal phase shift varying relatively slowly with frequency in the 2⅞-in pipe but changes more dramatically in the 5-in pipe. In contrast, the signal amplitudes plotted in FIG. 7*b* are more nearly constant as the frequency changes for both pipe sizes. Thus, a free point tool constructed with a coil spacing of 12 inches can provide useful amplitude measurements over a range of pipe sizes that will be relatively insensitive to changes in operating frequency.

More specifically, in FIG. 7*a*, it can be seen that there are significant differences in phase shift that can exist over a frequency range of a free point tool disposed in a 5" pipe and a 2⅞" pipe with a fixed coil spacing. In contrast, in FIG. 7*b* it can be seen that under the same conditions, the amplitude change between data collected from a 5" pipe and a 2⅞" pipe tend to converge and track one another closely. These graphs illustrate the desirability to utilize amplitude change in identifying stuck points for tools intended to be used in a variety of pipe sizes. The use of amplitude change in this regard is not as sensitive to certain parameters, such as pipe size or frequency, as is phase shift. As is illustrated, phase shifts can vary dramatically with a changing pipe size. Amplitude measurements are less sensitive to these varied parameters and tend to yield a much more uniform or constant response as parameters change. In other words, in order to be sufficiently robust to identify stuck points in a variety of pipe sizes, a tool with a fixed coil spacing should utilize amplitude change of the reflected electromagnetic signal from stressed and unstressed pipes to identify the stuck points.

In another embodiment of the invention, tool 100, 200 can be utilized to measure wall thickness of the pipe in which it is disposed. To measure thickness, for an unstressed pipe string, amplitude or phase over the pipe length is determined. Assuming that permeability and electrical conductivity are substantially constant, changes in phase or amplitude can be utilized to identify changes in the thickness of the pipe, which those skilled in the art will appreciate can be used to detect corrosion, irregularities and other conditions of the pipe. Likewise, since collars are simply thicker portions of a pipe, collars can be identified utilizing this same technique.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A method for determining the free point of a downhole pipe comprising: (a) providing a downhole electromagnetic free point tool comprising a housing, a transmitter coil disposed within the housing, a plurality of receiver coils disposed within the housing, each receiver coil spaced at a different distance from the transmitter coil, a power source electrically coupled to the transmitter coil configured to apply an oscillating voltage to the transmitter coil so as to induce a current in each of the receiver coils, and electronics configured to measure the induced current in each of the receiver coils; (b) displacing the downhole electromagnetic free point tool within the pipe longitudinally for a first distance; (c) energizing the transmitter coil over the first distance with an oscillating voltage; (d) measuring a current induced in each of the receiver coils during step (b); (e) generating a first log of amplitude measurements based on steps b-d; (f) applying a physical stress to the pipe at or near the surface; (g) displacing the downhole electromagnetic free point tool longitudinal within the pipe for a second distance wherein the second distance overlaps at least a portion of the first distance during step (f); (h) energizing the transmitter coil with an oscillating voltage from the power source during step (g); (i) measuring a current induced in each of the receiver coils during step (g); (j) generating a second log of amplitude measurements based on steps g-i; and (k) comparing the amplitude change between the first log and the second log to determine the free point of the pipe.

2. The method of claim 1 wherein the physical stress is a torsional stress.

3. The method of claim 1 wherein the physical stress is a tensional stress.

4. The method of claim 1 wherein the oscillating voltage is at a frequency of about 30 to about 150 Hz.

5. The method of claim 1 wherein each receiver coil is spaced at a distance from an adjacent receiver coil of about 6 to about 16 inches.

6. The method of claim 1, further comprising the step of utilizing a phase sensitive detector to filter the induced currents in the receiver coils.

7. The method of claim 1, comprising the step of altering the frequency of the oscillating voltage based on the position of the tool in the pipe.

8. The method of claim 7, wherein the downhole pipe is disposed in a wellbore that is partially cased and partially open hole, wherein the oscillating voltage has a first frequency when the tool is disposed in the cased portion of the wellbore and the oscillating voltage has a second frequency, different than the first frequency, when the tool is disposed in the open hole portion of the wellbore.

9. The method of claim 8, wherein a first receiver coil measures the oscillating voltage having a first frequency and a second receiver coil measures the oscillating voltage having a second frequency.

10. A method for determining the free point of a downhole pipe comprising: (a) providing a downhole electromagnetic free point tool comprising a housing, a plurality of transmitter coils disposed within the housing, a receiver coil disposed within the housing, a power source electrically coupled to the transmitter coils for applying an oscillating voltage to the transmitter coils so as to induce a current in the receiver coil, and electronics for measuring the induced current in the receiver coil; (b) displacing the downhole electromagnetic free point tool within the pipe longitudinally for a first distance; (c) energizing the transmitter coils with an oscillating voltage from the power source during step (b); (d) measuring a current induced in the receiver coil during step (b); (e) generating a first log of amplitude measurements based on steps b-d; (f) applying a physical stress to the pipe at or near the surface; (g) displacing the downhole electromagnetic free point tool longitudinal within the pipe for a second distance wherein the second distance overlaps at least a portion of the first distance during step (f); (h) energizing the transmitter coils with an oscillating voltage from the power source during step (g); (i) measuring a current induced in the receiver coil during step (g); (j) generating a second log of amplitude measurements based on steps g-i; and (k) comparing the first log to the second log to determine the free point of the pipe.

11. The method of claim 10, further comprising the step of utilizing phase sensitive detector to filter the induced currents in the receiver coil.

12. The method of claim 10, wherein each transmitter coil is energized with a different frequency oscillating voltage.

13. A method for determining the free point of a downhole pipe comprising: (a) providing a downhole electromagnetic free point tool comprising a housing, a transmitter coil disposed within the housing, a receiver coil disposed within the housing, said receiver coil spaced apart from the transmitter coil, a power source electrically coupled to the transmitter coil configured to apply an oscillating voltage to the transmitter coil so as to induce a current in said receiver coil, and electronics configured to measure the induced current in said receiver coil; (b) adjusting the spacing between the receiver coil and the transmitter coil based on one or more characteristics of the downhole pipe; (c) displacing the downhole electromagnetic free point tool within the pipe longitudinally for a first distance; (d) energizing the transmitter coil over the first distance with an oscillating voltage; (e) measuring a current induced in the receiver coil during step (d); (f) generating a first log of amplitude measurements based on steps c-e; (g) applying a physical stress to the pipe at or near the surface; (h) displacing the downhole electromagnetic free point tool longitudinal within the pipe for a second distance wherein the second distance overlaps at least a portion of the first distance; (i) energizing the transmitter coil with an oscillating voltage; (j) measuring a current induced in the receiver coil during step (i); (k) generating a second log of amplitude measurements based on steps h-j; and (l) comparing the amplitude change between the first log and the second log to determine the free point of the pipe.

14. The method of claim 13, further comprising the step of utilizing a phase sensitive detector to filter the induced currents in the receiver coil.

15. The method of claim 13, wherein the spacing between the coils is adjusted while the tool is downhole.

16. A downhole electromagnetic free point system for determining the location of the free point in a wellbore, the system comprising: a pipe string disposed in the wellbore; and an electromagnetic free point tool disposed within the pipe string, said free point tool comprising a housing; a transmitter coil disposed within the housing; a plurality of receiver coils disposed within the housing, each receiver coil spaced at a different distance from the transmitter coil; a power source electrically coupled to the transmitter coil configured to apply an oscillating voltage to the transmitter coil so as to induce a current in each of the receiver coils; and electronics configured to measure the induced current in each of the receiver coils.

17. The downhole electromagnetic free point system of claim 16 wherein the electronics comprise a phase sensitive detector configured to determine the phase of the induced current in each of the receiver coils relative to the applied voltage of the transmitter coil.

18. The downhole electromagnetic free point system of claim 17 wherein the phase sensitive detector is a lock-in amplifier.

19. The downhole electromagnetic free point system of claim 16 wherein the electronics further comprise a memory for storing measured data.

20. The downhole free point system of claim 16 wherein the electronics further comprise telemetry for communicating measured data to the surface.

21. The downhole free point system of claim 16 wherein the housing is non-magnetic.

22. The downhole electromagnetic free point system of claim 16, wherein said power source is a wireline.

23. A downhole electromagnetic free point tool for determining the position of the free point of a downhole pipe comprising: a housing; a transmitter coil disposed within the housing; a plurality of receiver coils disposed within the housing, each receiver coil spaced at a different distance from the transmitter coil; a power source electrically coupled to the transmitter coil configured to apply an oscillating voltage to the transmitter coil so as to induce a current in each of the receiver coils; and electronics configured to measure the induced current in each of the receiver coils, wherein the downhole pipe is further disposed in a casing.

24. A downhole electromagnetic free point tool for determining the position of the free point of a downhole pipe comprising: a housing; a transmitter coil disposed within the housing; a plurality of receiver coils disposed within the housing, each receiver coil spaced at a different distance from the transmitter coil; a power source electrically coupled to the transmitter coil configured to apply an oscillating voltage to the transmitter coil so as to induce a current in each of the receiver coils; and electronics configured to measure the induced current in each of the receiver coils, wherein the downhole pipe is further disposed in another tubular pipe.

25. A downhole electromagnetic free point tool for determining the position of the free point of a downhole pipe comprising: a housing; a transmitter coil disposed within the housing; a plurality of receiver coils disposed within the housing, each receiver coil spaced at a different distance from the transmitter coil; a power source electrically coupled to the transmitter coil configured to apply an oscillating voltage to the transmitter coil so as to induce a current in each of the receiver coils; and electronics configured to measure the induced current in each of the receiver coils, within the housing wherein the transmitter coil and the plurality of receiver coils are disposed about the mandrel.

26. A downhole electromagnetic free point system for determining the location of a free point in a wellbore, the system comprising: a pipe string disposed in the wellbore; and an electromagnetic free point tool disposed within the pipe string, said free point tool comprising a housing; a plurality of transmitter coils disposed within the housing, each transmitter coil spaced apart from one another; a receiver coil disposed within the housing; a power source configured to energize the transmitter coil so as to induce a current in the receiver coil; electronics configured to measure the current induced in the receiver coil.

27. The downhole electromagnetic free point system of claim 26 wherein the electronics are further configured to determine the amplitude of the induced current in each of the receiver coils.

28. The downhole electromagnetic free point system of claim 26 wherein the electronics comprise a phase sensitive detector configured to determine the phase of the induced current in each of the receiver coils relative to the applied voltage of the transmitter coil.

29. The downhole electromagnetic free point system of claim 28 wherein the phase sensitive detector comprises a lock-in amplifier.

30. The downhole electromagnetic free point system of claim 26, wherein said power source is a wireline.

31. A downhole electromagnetic free point tool for determining the position of the free point of a downhole pipe comprising: a housing; a transmitter coil disposed within the housing; a receiver coil disposed within the housing and spaced apart from said transmitter coil, wherein at least one of the coils is adjustable relative to the other coil; a power source configured to energize the transmitter coil so as to induce a current in the receiver coil; electronics configured to measure the current induced in the receiver coil.

32. The downhole electromagnetic free point tool of claim 31 wherein the electronics are further configured to determine the amplitude of the induced current in each of the receiver coils relative to the applied voltage of the transmitter coil.

33. The downhole electromagnetic free point tool of claim 31 wherein the electronics comprise a phase sensitive detector configured to determine the phase of the induced current in each of the receiver coils relative to the applied voltage of the transmitter coil.

34. A method for locating collars in a downhole pipe comprising: (a) providing a downhole electromagnetic free point tool comprising a housing, one or more transmitter coils disposed within the housing, one or more receiver coils disposed within the housing, said coils spaced apart from one another, a power source electrically coupled to the transmitter coil configured to apply an oscillating voltage to the transmitter coil so as to induce a current in each of the receiver coils, and electronics configured to measure the induced current in each of the receiver coils; (b) displacing the downhole electromagnetic free point tool within the pipe longitudinally; (c) energizing one or more of the one or more transmitter coils with an oscillating voltage; (d) measuring a current induced in each of the one or more receiver coils during step (c); (e) filtering the current measured in step (d) with a phase sensitive detector; and (f) identifying the location of collars in a downhole pipe based on changes in the filtered current output of step (e).

35. The method of claim 34, wherein the step of identifying comprises plotting the filtered current of step (e) in each of the one or more receiver coils on a chart to display the location of the collars.

* * * * *